US011465003B2

(12) United States Patent
Zhu et al.

(10) Patent No.: US 11,465,003 B2
(45) Date of Patent: Oct. 11, 2022

(54) BUFFERED WALL FLOW MULTI-CHANNELS FLAME ARRESTER

(71) Applicant: JIANGSU UNIVERSITY, Zhenjiang (CN)

(72) Inventors: Yuejin Zhu, Zhenjiang (CN); Zhenhua Pan, Zhenjiang (CN); Zhiwei Yang, Zhenjiang (CN); Penggang Zhang, Zhenjiang (CN); Jianfeng Pan, Zhenjiang (CN)

(73) Assignee: Jiangsu University, Jiangsu (CN)

( * ) Notice: Subject to any disclaimer, the term of this patent is extended or adjusted under 35 U.S.C. 154(b) by 409 days.

(21) Appl. No.: 16/627,105

(22) PCT Filed: Aug. 2, 2018

(86) PCT No.: PCT/CN2018/098234
§ 371 (c)(1),
(2) Date: Dec. 27, 2019

(87) PCT Pub. No.: WO2020/015022
PCT Pub. Date: Jan. 23, 2020

(65) Prior Publication Data

US 2021/0331012 A1 Oct. 28, 2021

(30) Foreign Application Priority Data

Jul. 18, 2018 (CN) ..... 201810807043.9

(51) Int. Cl.
*A62C 4/02* (2006.01)

(52) U.S. Cl.
CPC ..... *A62C 4/02* (2013.01)

(58) Field of Classification Search
CPC ..... A62C 4/02
See application file for complete search history.

(56) References Cited

U.S. PATENT DOCUMENTS 5,402,603 A * 4/1995 Henley ..... A62C 4/02 48/190
5,415,233 A * 5/1995 Roussakis ..... B01J 19/002 169/48

(Continued)

FOREIGN PATENT DOCUMENTS

CN 2593823 Y 12/2003
CN 104274929 A 1/2015

(Continued)

*Primary Examiner* — Justin M Jonaitis
(74) *Attorney, Agent, or Firm* — Heslin Rothenberg Farley & Mesiti, P.C.

(57) ABSTRACT

The present invention belongs to the field of flame arresters, and discloses a buffered wall flow multi-channels flame arrester. The flame arrester comprises a buffering and splitting cover and a Z-type wall flow multi-channels flame arresting core, wherein the buffering and splitting cover has a round-bottom plain-top cylindrical shape or hemispherical shape, with pinholes distributed in the cover surface, and channels are arranged inside the Z-type wall flow multi-channels flame arresting core. In every two adjacent channels, the inlet of one channel is blocked, and the outlet of the other channel is blocked, and in the height direction in the central cross section of the flame arresting core, pinholes are arranged in the wall surfaces between adjacent channels, and adjacent upper and lower channels constitute a fluid channel.

11 Claims, 4 Drawing Sheets

(56) References Cited

U.S. PATENT DOCUMENTS

| | | | | |
|---|---|---|---|---|
| 2001/0000837 | A1* | 5/2001 | Leinemann | A62C 4/02<br>220/88.1 |
| 2003/0022116 | A1* | 1/2003 | Brooker | F23D 14/82<br>431/2 |
| 2003/0044740 | A1* | 3/2003 | Brooker | A62C 4/02<br>431/252 |
| 2010/0218958 | A1* | 9/2010 | Cooling | A62C 4/02<br>169/45 |

FOREIGN PATENT DOCUMENTS

| | | | | |
|---|---|---|---|---|
| CN | 204745422 | U | 11/2015 | |
| CN | 205379565 | U | 7/2016 | |
| EP | 1586350 | A1 * | 10/2005 | A62C 4/02 |
| GB | 1035705 | | 7/1966 | |

* cited by examiner

BUFFERED WALL FLOW MULTI-CHANNELS FLAME ARRESTER

CROSS REFERENCE TO RELATED APPLICATIONS

This application is a U.S. National Phase filing under 35 U.S.C. § 371 of International Application PCT/CN2018/098234, filed Aug. 2, 2018. PCT/CN2018/098234 claims priority from Chinese Patent Application Number 201810807043.9, filed Jul. 18, 2018. The entire contents of each of these applications are hereby expressly incorporated herein by reference.

I. TECHNICAL FIELD

The present invention belongs to the field of flame arresters, and particularly relates to a buffered wall flow multi-channels flame arrester.

II. BACKGROUND ART

In industrial practice, various kinds of flame arresters are often installed in applications such as petroleum product storage tanks or flammable gas pipelines, in order to quickly suppress the spreading, development or even detonation of the flame in an accidental fire resulted from various accidents, and thereby greatly improve security.

Functionally speaking, flame arresters can be categorized into deflagration flame arresters and detonation flame arresters, wherein deflagration flame pipeline arresters can suppress the propagation and spreading of subsonic flame, while detonation flame pipeline arresters can suppress the propagation and spreading of supersonic flame. Structurally speaking, traditional flame arresters are mainly composed of a flame arresting core and a flame arrester shell, wherein the flame arresting core mainly quenches the deflagration or detonation flame in the pipeline and is the main component for suppressing flame propagation, while the flame arrester shell forms an internal expansion chamber that mainly decreases the propagation speed of the deflagration or detonation flame and the pressure of the flame front, and shall have higher strength.

At present, there are two viewpoints on the quenching mechanism of flame in flame arresters: heat transfer and wall effect. According to the viewpoint based on heat transfer, the flame turns into a lot of small flames when it passes through the tiny slits of the flame arrester, the small flames transfer heat to the slit wall surfaces as they contact with the slit wall surfaces that are at a lower temperature, and thereby the temperature of the small flames is decreased quickly, and finally the flames are extinguished when the temperature is not enough to maintain the fuel combustion. While according to the viewpoint of wall effect, combustion happens because active free radicals with short lives are produced by the destruction of the molecular bonds of the reactants and those free radicals collide with other molecules and thereby new free radicals are generated so that the reaction continues. When the flame passes through the slits of the flame arrester, the probability of collision between the free radicals and the wall surfaces increases, the quantity of free radicals involved in the reaction is decreased sharply, and the flame is quenched when the reaction can't continue. When the flame passes through the traditional flame arresting core, the probability of collision between the free radicals and the wall surfaces is relatively low, the heat transfer effect is not significant, and the flame arresting effect is not very good. In addition, it has been found in researches that the propagation speed of the flame and the pressure wave of the flame front can be attenuated to a certain degree and thereby the flame arresting effect can be improved greatly by adding a buffer barrier to the expansion chamber of the flame arrester in the direction of the fuel gas inlet, meanwhile, the fuel gas flow resistance is increased by the buffer barrier.

III. CONTENTS OF THE INVENTION

To solve the problems in the prior art, the present invention designs a buffered wall flow multi-channels flame arrester, which has a Z-type wall flow multi-channels flame arresting core structure that changes the flow direction of the flame and enhances the effect of heat transfer from the flame to the walls and increases the probability of collision between the free radicals and the channel wall surfaces in the combustion process; in addition, the present invention designs a novel buffering and splitting cover at the inlet end face of the Z-type wall flow multi-channels flame arresting core, when deflagration or detonation flame occurs, the buffering and splitting cover can decrease the propagation speed of the flame and the pressure of the flame front and greatly improve the flame quenching ability of the flame arrester, and thereby greatly improves security.

A buffered wall flow multi-channels flame arrester, comprising a gas inlet pipeline, two pairs of flange groups, a flame arrester shell, flame arrester flanges, a gas outlet pipeline, a flame arrester expansion chamber, a buffering and splitting cover, and a multi-channels flame arresting core.

The flame arrester shell comprises a front wall and a back wall, the gas inlet pipeline is connected to the front wall of the flame arrester shell via a first flange group, the back wall of the flame arrester shell is connected to the gas outlet pipeline via a second flange group, the buffering and splitting cover and a Z-type wall flow multi-channels flame arresting core are installed between the front wall and the back wall of the flame arrester shell, and the opening of the buffering and splitting cover as described is fixedly connected to the Z-type wall flow multi-channels flame arresting core; in addition, the front wall and the back wall of the flame arrester shell are fixed by the flame arrester flanges to attain a sealing effect.

A flame arrester expansion chamber is formed in the front wall and the back wall of the flame arrester shell respectively, the inner diameter of the flame arrester expansion chamber is 2.5 times of the diameter of the gas inlet pipeline, and both of the divergence angles of the front wall and the back wall of the flame arrester shell are 120°.

The buffering and splitting cover has round-bottom plain-top cylindrical gratings or hemispherical gratings, hollow inside and opening is toward the back wall of the flame arrester shell; rectangular holes, square holes, rhombic holes, round holes, slotted holes, hexagonal holes, or octagonal holes are distributed in the entire cover surface.

In the case that the buffering and splitting cover has round-bottom plain-top cylindrical gratings, the inner diameter of the cover is equal to the diameter of the gas inlet pipeline, and the length of the cover is equal to the inner diameter of the cover.

In the case that the buffering and splitting cover has hemispherical gratings, the inner diameter of the cover is equal to the inner diameter of the flame arrester expansion chamber, and the length of the cover is equal to ½ of the inner diameter of the flame arrester expansion chamber.

The dimensions of the buffering and splitting cover may be adjusted according to the combustion characteristics of the fuel, so as to achieve optimal flame arresting performance.

Furthermore, the multi-channels flame arresting core is a Z-type wall flow multi-channels flame arresting core, the outer wall of the Z-type wall flow multi-channels flame arresting core contacts with the inner wall of the flame arrester shell, several layers of fluid channels are arranged inside the Z-type wall flow multi-channels flame arresting core, each fluid channel comprises a channel A and a channel B, wherein the outlet of the channel A is blocked, and the inlet of the channel B is blocked, and pinholes c are arranged in the wall surfaces between adjacent channels, so that the channel A communicates with the adjacent channel B at one side, and communicates with an adjacent channel B' at the other side; namely, the upper and lower channels with a blocked inlet communicate with the channels with a blocked outlet, the fuel gas flows into the fire arrester via the channel A, and can flow out of the fire arrester via the channel B or channel B'.

Furthermore, the multi-channels flame arresting core is a Z-type wall flow multi-channels flame arresting core, the outer wall of the Z-type wall flow multi-channels flame arresting core contacts with the inner wall of the flame arrester shell, several fluid channels are arranged inside the Z-type wall flow multi-channel flame arresting core, each fluid channel comprises a channel A and a channel B, wherein the outlet of the channel A is blocked, and the inlet of the channel B is blocked, and pinholes c are arranged in the wall surfaces between adjacent channels, so that the channel A communicates with adjacent channels B, B1, B2, and B3 at the top, bottom, left, and right sides; namely, the upper, lower, left, and right channels with a blocked inlet communicate with the central channels with a blocked outlet, the fuel gas flows into the fire arrester via the channel A, and can flow out of the fire arrester via the channel B, B1, B2, or B3.

The channel A and the channel B have the same height.

All of the pinholes c are in the same height direction in the central cross section of the Z-type wall flow multi-channels flame arresting core, and the diameter of the pinholes c is equal to 1-2 times of the height of the channel A.

The flame arrester shell, the buffering and splitting cover, and the multi-channels flame arresting core are made of carbon steel or stainless steel.

The operating process of the buffered wall flow multi-channels flame arrester is as follows: when deflagration or detonation flame occurs, the buffering and splitting cover buffers, splits, obstructs, and diffracts the stronger flame and pressure wave at the central part of the flame arrester expansion chamber, and thereby decreases the front gas pressure at the center of the Z-type wall flow multi-channels flame arresting core. Then, the flame at the central part passes through the pinholes in the buffering and splitting cover and enters into the cover, and then flows into the Z-type wall flow multi-channels flame arresting core via the channel inlets that are not blocked in the inlet end face of the flame arresting core; owing to the fact that the outlet end faces of those channels in the flame arresting core are blocked, the flame are forced to flow into adjacent channels via the openings in the wall surfaces of the channels, and then flow out via the outlets of the adjacent channels. As a result, the probability of collision between the free radicals produced in the combustion process and the channel wall surfaces is greatly increased, which is helpful for flame quenching. The flame near the circumference of the flame arrester expansion chamber that doesn't pass through the buffering and splitting cover can directly flow into the Z-type wall flow multi-channels flame arresting core after it passes through the flame arrester expansion chamber; likewise, the probability of collision between the free radicals produced in the combustion process and the channel wall surfaces is increased, which is helpful for flame quenching.

The present invention attains the following beneficial effects:

When deflagration or detonation flame occurs in the fuel gas pipeline, the flame propagated at a high speed and the strong pressure wave interacts with the buffering and splitting cover first, so that the gas pressure at the center of the flame arresting core is decreased to a certain degree, meanwhile, the propagation speed of the flame is also decreased; then, when the flame passes through the Z-type wall flow multi-channels flame arresting core, the probability of collision between the free radicals excited in the combustion process and the wall surfaces of the channels is greatly increased, which is helpful for flame quenching, and thereby the security is improved.

IV. DESCRIPTION OF DRAWINGS

FIG. 1 is a schematic diagram of the buffered wall flow multi-channels flame arrester according to embodiment 1 of the present invention;

FIG. 2 provides three views of the buffering and splitting cover in the embodiment 1 of the present invention; a—front view, b—top view, c—left view;

In the figures: 1—gas inlet pipeline; 2—first flange group; 3—flame arrester shell; 4—flame arrester expansion chamber; 5—flame arrester flange; 6—buffering and splitting cover; 7—Z-type wall flow multi-channels flame arresting core; 8—second flange group; 9—gas outlet pipeline.

V. EMBODIMENTS

Hereunder the present invention will be further detailed in embodiments with reference to the accompanying drawings, but the protection scope of the present invention is not limited to these embodiments.

Embodiment 1

Figure 1:
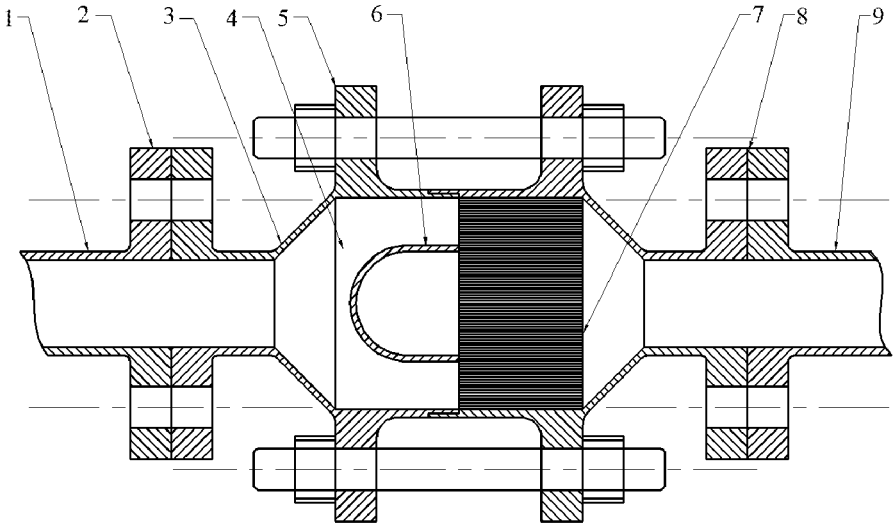

As shown in FIG. 1, a buffered wall flow-type multi-channels flame arrester comprises a gas inlet pipeline 1, three pairs of flange groups, aflame arrester shell 3, flame arrester flanges 5, a gas outlet pipeline 9, a flame arrester expansion chamber 4, a buffering and splitting cover 6, and a Z-type wall flow multi-channels flame arresting core 7; the flame arrester shell 3 comprises a front wall and a back wall, the gas inlet pipeline 1 is connected via a first flange group 2 to the front wall of the flame arrester shell, the back wall of the flame arrester shell is connected via a second flange group 8 to the gas outlet pipeline 9, the buffering and splitting cover 6 and a Z-type wall flow multi-channels flame arresting core 7 are installed between the front wall and the back wall of the flame arrester shell, and the opening of the buffering and splitting cover 6 is fixedly connected to the Z-type wall flow multi-channels flame arresting core 7; the front wall of the flame arrester shell 3 may be embedded in the back wall of the shell and fixed by the flame arrester flange 5; a flame arrester expansion chamber 4 is formed in the front wall and the back wall of the flame arrester shell 3 respectively, the inner diameter of the flame arrester expansion chamber is about 2.5 times of the diameter of the gas inlet pipeline 1, and both of the divergence angles of the front wall and the back wall of the flame arrester shell are 120°.

Figure 2A:
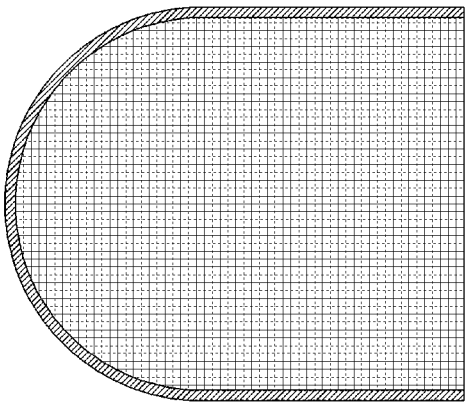
Figure 2B:
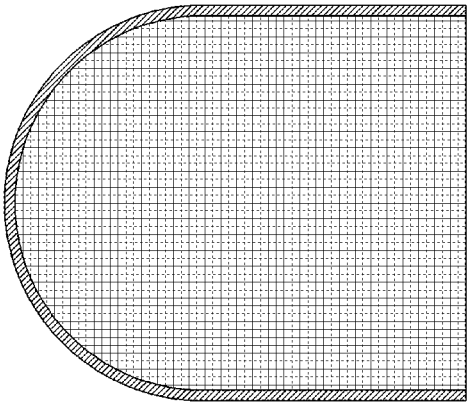
Figure 2C:
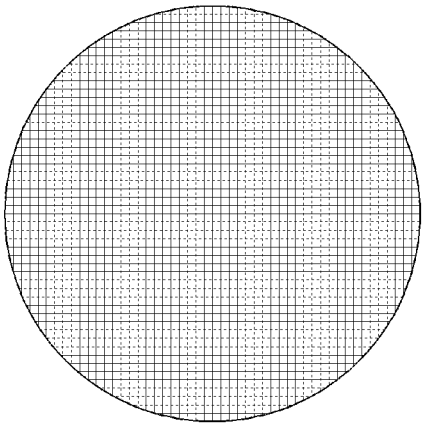

As shown in FIG. 2, the buffering and splitting cover 6 has round-bottom plain-top cylindrical gratings, hollow inside and opening is toward the back wall of the flame arrester shell; rectangular holes, square holes, rhombic holes, round holes, slotted holes, hexagonal holes, or octagonal holes are distributed in the entire cover surface; the inner diameter of the cover is equal to the diameter of the gas inlet pipeline 1, and the length of the cover is equal to the inner diameter of the cover.

Figure 5:
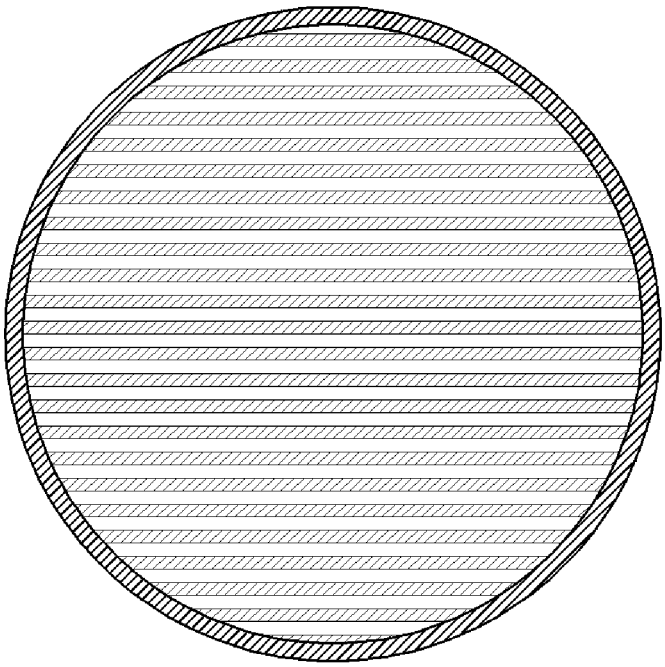
FIG. 5 is a schematic diagram of the inlet of the Z-type wall flow multi-channels flame arresting core in embodiment 1 of the present invention.
Figure 6:
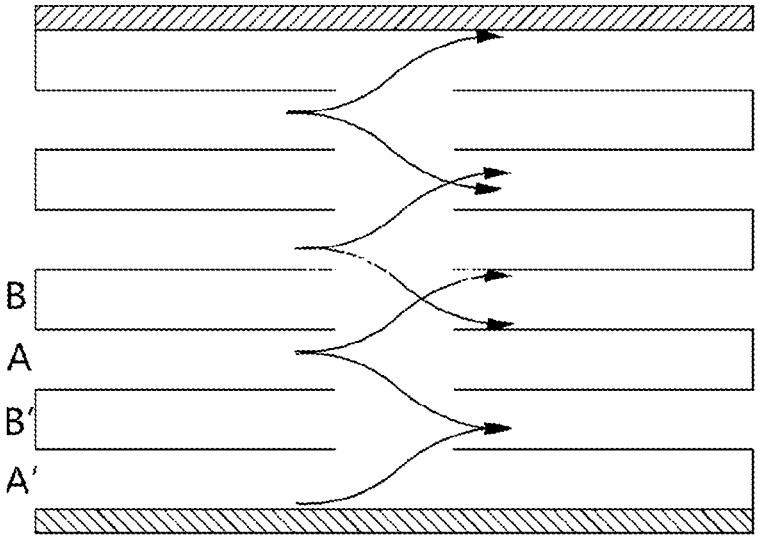
FIG. 6 is a schematic diagram of gas flow in the Z-type wall flow multi-channels flame arresting core in embodiment 1 of the present invention.

The outer wall of the Z-type wall flow multi-channels flame arresting core 7 contacts with the inner wall of the flame arrester shell 3, as shown in FIG. 6, several layers of fluid channels are arranged inside the Z-type wall flow multi-channels flame arresting core 7, each fluid channel comprises a channel A and a channel B as shown in FIG. 5, wherein the outlet of the channel A is blocked, and the inlet of the channel B is blocked, and pinholes c are arranged in the wall surfaces between adjacent channels, so that the channel A communicates with adjacent channel B at one side, and communicates with channel B' at the other side; namely, the upper and lower channels with a blocked inlet communicate with the channels with a blocked outlet, the fuel gas flows into the fire arrester via the channel A, and can flow out of the fire arrester via the channel B or channel B'.

The channel A and the channel B have the same height.

All of the pinholes c are in the same height direction in the central cross section of the Z-type wall flow multi-channel flame arresting core, and the diameter of the pinholes c is equal to 1-2 times of the height of the channel A.

The flame arrester shell 3, the buffering and splitting cover 6, and the Z-type wall flow multi-channel flame arresting core 7 are made of carbon steel or stainless steel.

Embodiment 2

Figure 3:
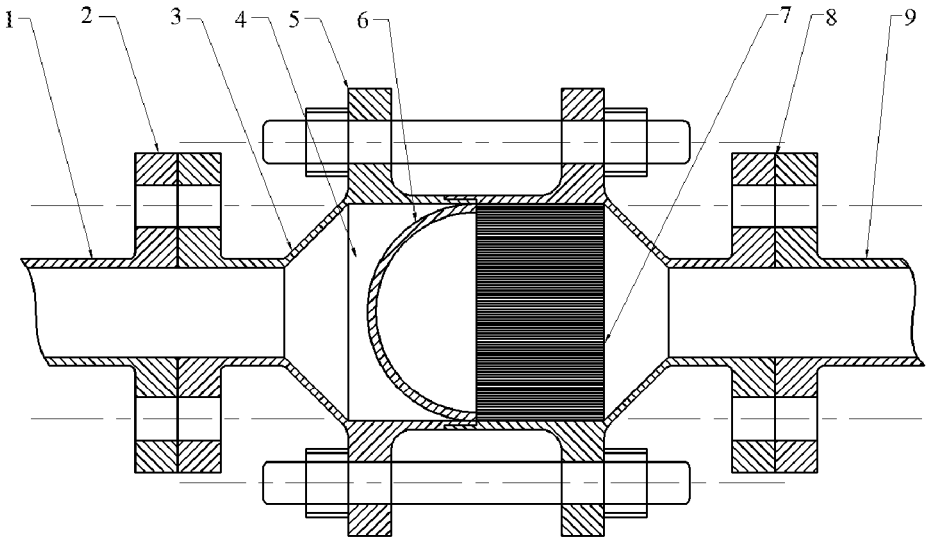
FIG. 3 is a schematic diagram of the buffered wall flow multi-channels flame arrester according to embodiment 2 of the present invention.

As shown in FIG. 3, a buffered wall flow multi-channels flame arrester comprises a gas inlet pipeline 1, three pairs of flange groups, a flame arrester shell 3, flame arrester flange 5, a gas outlet pipeline 9, a flame arrester expansion chamber 4, a buffering and splitting cover 6, and a z-type wall flow multi-channels flame arresting core 7.

The flame arrester shell 3 comprises a front wall and a back wall, the gas inlet pipeline 1 is connected via a first flange group 2 to the front wall of the flame arrester shell, the back wall of the flame arrester shell is connected via a second flange group 8 to the gas outlet pipeline 9, the buffering and splitting cover 6 and a Z-type wall flow multi-channel flame arresting core 7 are installed between the front wall and the back wall of the flame arrester shell, and the opening of the buffering and splitting cover 6 is fixedly connected to the Z-type wall flow multi-channel flame arresting core 7; the front wall of the flame arrester shell 3 may be embedded in the back wall of the shell and fixed by the flame arrester flange 5; a flame arrester expansion chamber 4 is formed in the front wall and the back wall of the flame arrester shell 3 respectively, the inner diameter of the flame arrester expansion chamber is about 2.5 times of the diameter of the gas inlet pipeline 1, and both of the divergence angles of the front wall and the back wall of the flame arrester shell are 120°.

Figure 4:
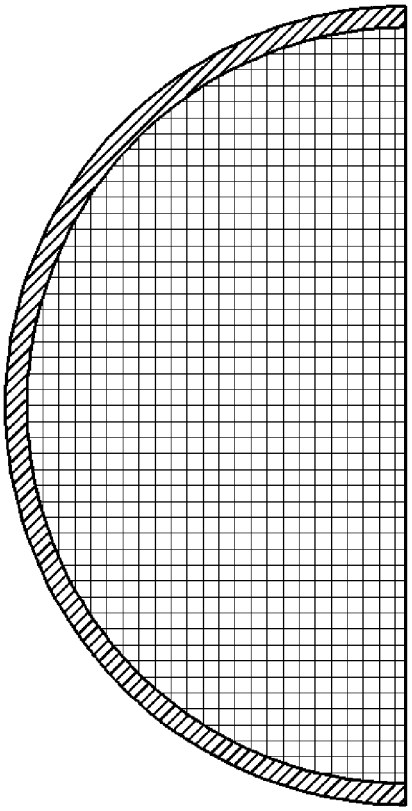
FIG. 4 is a schematic diagram of the buffering and splitting cover in embodiment 2 of the present invention.

As shown in FIG. 4, the buffering and splitting cover 6 has semispherical gratings, hollow inside and opening is toward the back wall of the flame arrester shell; rectangular holes, square holes, rhombic holes, round holes, slotted holes, hexagonal holes, or octagonal holes are distributed in the entire cover surface; the inner diameter of the cover is equal to the inner diameter of the flame arrester expansion chamber 4, and the length of the cover is equal to ½ of the inner diameter of the flame arrester expansion chamber 4.

Figure 7:
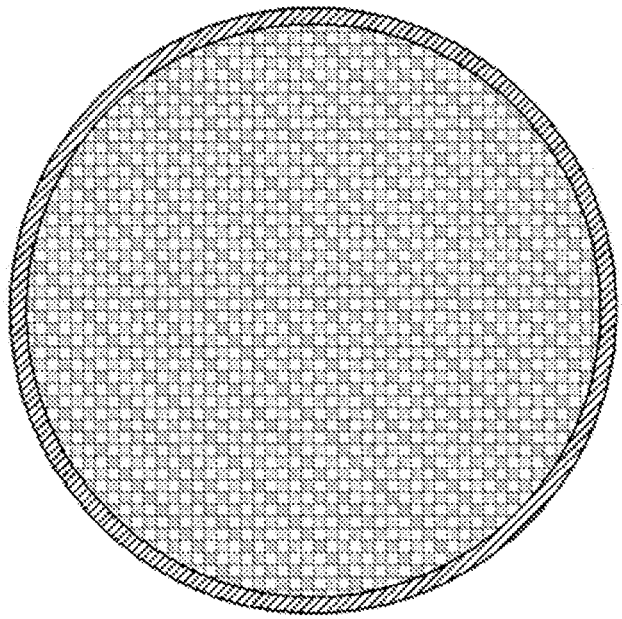
FIG. 7 is a schematic diagram of the inlet of the Z-type wall flow multi-channels flame arresting core in embodiment 2 of the present invention.
Figure 8:
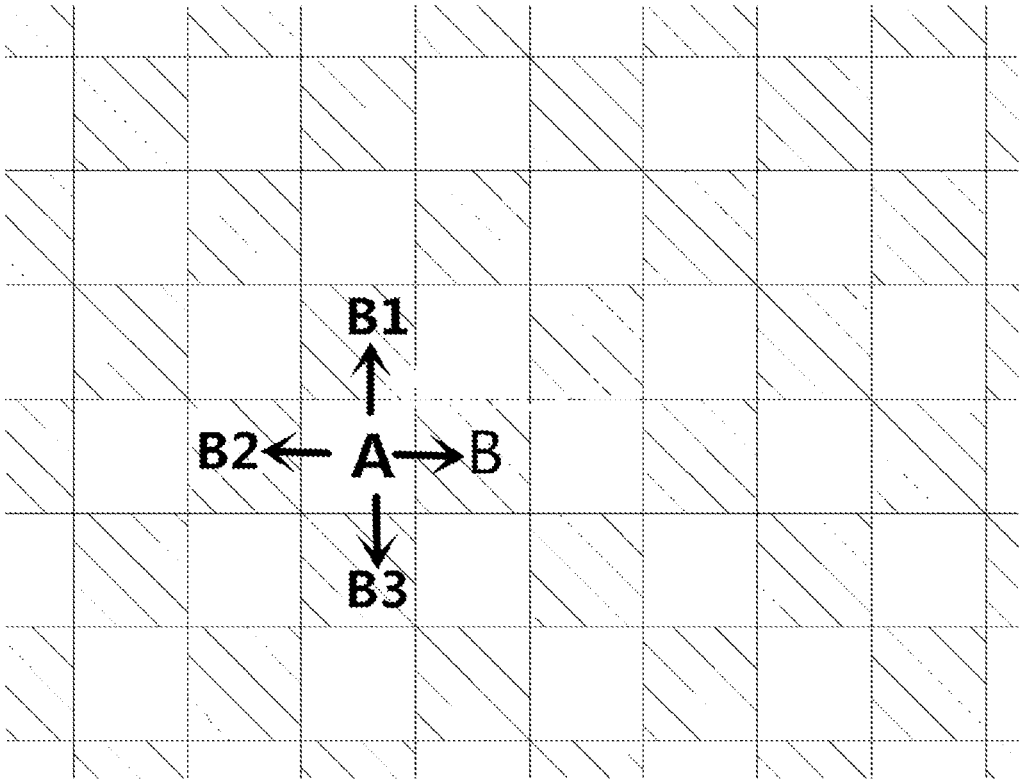
FIG. 8 is a schematic diagram of gas flow in the fluid channels in different arrangements in embodiment 2 of the present invention.

The outer wall of the Z-type wall flow multi-channels flame arresting core 7 contacts with the inner wall of the flame arrester shell 3, as shown in FIG. 7, several fluid channels are arranged inside the Z-type wall flow multi-channels flame arresting core 7, each fluid channel comprises a channel A and a channel B as shown in FIG. 5, wherein the outlet of the channel A is blocked, and the inlet of the channel B is blocked, and pinholes c are arranged in the wall surfaces between adjacent channels, so that the channel A communicates with adjacent channels B, B1, B2, and B3 at the upper, lower, left, and right sides; namely, the upper, lower, left, and right channels with a blocked inlet communicate with the central channels with a blocked outlet, as shown in FIG. 5, the fuel gas flows into the fire arrester via the channel A, and can flow out of the fire arrester via the channel B, B1, B2, or B3.

The channel A and the channel B have the same height.

All of the pinholes c are in the same height direction in the central cross section of the Z-type wall flow multi-channels flame arresting core, and the diameter of the pinholes c is equal to 1 to 2 times of the height of the channel A.

The flame arrester shell 3, the buffering and splitting cover 6, and the Z-type wall flow multi-channels flame arresting core 7 are made of carbon steel or stainless steel.

When deflagration or detonation flame occurs, the buffering and splitting cover 6 buffers, splits, obstructs, and diffracts the stronger flame and pressure wave at the central part of the flame arrester expansion chamber 4, and thereby decreases the front gas pressure at the center of the Z-type wall flow multi-channels flame arresting core 7. Then, the flame at the central part passes through the pinholes in the buffering and splitting cover 6 and enters into the cover, and then flows into the Z-type wall flow multi-channels flame arresting core 7 via the channel inlets that are not blocked in the inlet end face of the flame arresting core; owing to the fact that the outlet end faces of those channels in the flame arresting core are blocked, the flame are forced to flow into adjacent channels via the openings in the wall surfaces of the channels, and then flow out via the outlets of the adjacent channels. As a result, the probability of collision between the free radicals produced in the combustion process and the channel wall surfaces is greatly increased, which is helpful for flame quenching. The flame near the circumference of the flame arrester expansion chamber 4 that doesn't pass through the buffering and splitting cover 6 can directly flow into the Z-type wall flow multi-channels flame arresting core 7 after it passes through the flame arrester expansion chamber 4; likewise, the probability of collision between the free radicals produced in the combustion process and the channel wall surfaces is increased, which is helpful for flame quenching.

The invention claimed is:

1. A buffered wall flow multi-channels flame arrester, comprising a gas inlet pipeline, two pairs of flange groups, a flame arrester shell, a gas outlet pipeline, a buffering and splitting cover, and a multi-channels flame arresting core, wherein the flame arrester shell comprises a front wall and a back wall, the gas inlet pipeline is connected to the front wall of the flame arrester shell via a first flange group, the back wall of the flame arrester shell is connected to the gas outlet pipeline via a second flange group, the buffering and splitting cover and the multi-channels flame arresting core are installed between the front wall and the back wall of the flame arrester shell, and an opening of the buffering and splitting cover is fixedly connected to the multi-channels flame arresting core; the front wall and the back wall of the flame arrester shell are fixed by flame arrester flanges, a flame arrester expansion chamber is formed in the front wall and the back wall of the flame arrester shell respectively;

and wherein, the buffering and splitting cover has round-bottom plain-top cylindrical gratings or hemispherical gratings, a hollow inside and the opening is toward the back wall of the flame arrester shell; and wherein rectangular holes, square holes, rhombic holes, round holes, slotted holes, hexagonal holes, or octagonal holes are distributed in the entire cover surface.

2. The buffered wall flow multi-channels flame arrester according to claim 1, wherein, the inner diameter of the flame arrester expansion chamber is 2.5 times the diameter of the gas inlet pipeline, and both of the divergence angles of the front wall and the back wall of the flame arrester shell are 120° .

3. The buffered wall flow multi-channels flame arrester according to claim 1, wherein, in the case that the buffering and splitting cover has round-bottom plain-top cylindrical gratings, the inner diameter of the cover is equal to the diameter of the gas inlet pipeline, and the length of the cover is equal to the inner diameter of the cover.

4. The buffered wall flow multi-channels flame arrester according to claim 1, wherein, in the case that the buffering and splitting cover has hemispherical gratings, the inner diameter of the cover is equal to the inner diameter of the flame arrester expansion chamber, and the length of the cover is equal to ½ of the inner diameter of the flame arrester expansion chamber.

5. The buffered wall flow multi-channels flame arrester according to claim 1, wherein, the multi-channels flame arresting core is a Z-type wall flow multi-channels flame arresting core, the outer wall of the Z-type wall flow multi-channels flame arresting core contacts with the inner wall of the flame arrester shell, several layers of fluid channels are arranged inside the Z-type wall flow multi-channels flame arresting core, each fluid channel comprises a channel A and a channel B, wherein the outlet of the channel A is blocked, and the inlet of the channel B is blocked, and pinholes c are arranged in the wall surfaces between adjacent channels, so that the channel A communicates with the adjacent channel B at one side, and communicates with an adjacent channel B' at the other side.

6. The buffered wall flow multi-channels flame arrester according to claim 1, wherein, the multi-channels flame arresting core is a Z-type wall flow multi-channels flame arresting core, the outer wall of the Z-type wall flow multi-channels flame arresting core contacts with the inner wall of the flame arrester shell, several fluid channels are arranged inside the Z-type wall flow multi-channels flame arresting core, each fluid channel comprises a channel A and a channel B, wherein an outlet of the channel A is blocked, and an inlet of the channel B is blocked, and pinholes c are arranged in the wall surfaces between adjacent channels, so that the channel A communicates with adjacent channels B, B1, B2, and B3 at the upper, lower, left, and right sides.

7. The buffered wall flow multi-channels flame arrester according to claim 5, wherein, the channel A and the channel B have the same height.

8. The buffered wall flow multi-channels flame arrester according to claim 5, wherein, all of the pinholes c are in the same height direction in the central cross section of the Z-type wall flow multi-channels flame arresting core, and the diameter of the pinholes c is equal to 1 to 2 times of the height of the channel A.

9. The buffered wall flow multi-channels flame arrester according to claim 1, wherein, the flame arrester shell, the buffering and splitting cover, and the multi-channels flame arresting core are made of carbon steel or stainless steel.

10. The buffered wall flow multi-channels flame arrester according to claim 6, wherein, the channel A and the channel B have the same height.

11. The buffered wall flow multi-channels flame arrester according to claim 6, wherein, all of the pinholes c are in the same height direction in the central cross section of the Z-type wall flow multi-channels flame arresting core, and the diameter of the pinholes c is equal to 1 to 2 times of the height of the channel A.

* * * * *